US008667629B2

(12) United States Patent
Mohr et al.

(10) Patent No.: US 8,667,629 B2
(45) Date of Patent: Mar. 11, 2014

(54) STRETCHER PAD WITH CHILD RESTRAINT SYSTEM

(76) Inventors: Marion Mohr, Bonn (DE); Alois Schnitzler, Niederkassel (DE)

( * ) Notice: Subject to any disclaimer, the term of this patent is extended or adjusted under 35 U.S.C. 154(b) by 0 days.

(21) Appl. No.: 12/931,125

(22) Filed: Jan. 24, 2011

(65) Prior Publication Data

US 2011/0179572 A1 Jul. 28, 2011

(30) Foreign Application Priority Data

Jan. 25, 2010 (DE) ..... 10 2010 005 619

(51) Int. Cl.
*A47B 1/00* (2006.01)

(52) U.S. Cl.
USPC ..... 5/628; 5/625; 5/655

(58) Field of Classification Search
USPC ..... 5/625, 628, 655, 724, 694, 725, 726, 5/740, 655.9, 953, 737, 738, 499, 503.1; 128/869, 870
See application file for complete search history.

(56) References Cited

U.S. PATENT DOCUMENTS

| | | | | | |
|---|---|---|---|---|---|
| 919,159 | A | * | 4/1909 | Goddard | 5/628 |
| 2,309,464 | A | * | 1/1943 | Lucci et al. | 5/628 |
| 2,394,264 | A | * | 2/1946 | Robinson | 5/628 |
| 2,607,103 | A | * | 8/1952 | Davidson | 5/628 |
| 3,348,245 | A | * | 10/1967 | Shindler | 5/628 |
| 3,609,778 | A | * | 10/1971 | Zeiner | 5/628 |
| 3,680,554 | A | | 8/1972 | Sanchet | |
| 4,124,908 | A | * | 11/1978 | Burns et al. | 5/628 |
| 4,506,664 | A | * | 3/1985 | Brault | 5/628 |
| 4,534,075 | A | * | 8/1985 | Schnitzler | 5/628 |
| 4,601,075 | A | * | 7/1986 | Smith | 5/628 |
| 4,945,583 | A | | 8/1990 | Schnitzler | |
| 4,970,739 | A | * | 11/1990 | Bradford | 5/628 |
| 5,014,374 | A | * | 5/1991 | Williams | 5/628 |
| 5,014,724 | A | | 5/1991 | Miller | |
| 5,121,514 | A | * | 6/1992 | Rosane | 5/628 |
| 5,179,746 | A | * | 1/1993 | Rogers | 5/628 |
| 5,189,746 | A | * | 3/1993 | Horie | 5/628 |
| 5,211,186 | A | * | 5/1993 | Shoemaker et al. | 5/628 |
| 5,249,321 | A | * | 10/1993 | Graf | 5/628 |
| 5,400,448 | A | * | 3/1995 | Zwickey | 5/628 |
| 5,515,869 | A | * | 5/1996 | Powell et al. | 5/628 |
| 5,634,222 | A | * | 6/1997 | Zwickey | 5/628 |
| 5,860,176 | A | * | 1/1999 | Norberg | 5/628 |
| 5,865,780 | A | * | 2/1999 | Tuite | 5/628 |
| 5,975,081 | A | * | 11/1999 | Hood et al. | 128/870 |
| 6,227,201 | B1 | * | 5/2001 | Ferko, III | 128/869 |
| 6,363,936 | B1 | * | 4/2002 | McCormick et al. | 128/870 |

(Continued)

FOREIGN PATENT DOCUMENTS

| | | |
|---|---|---|
| DE | 10058346 A1 | 3/2002 |
| DE | 20317701 U1 | 2/2004 |

(Continued)

*Primary Examiner* — Robert G Santos
*Assistant Examiner* — David E Sosnowski
(74) *Attorney, Agent, or Firm* — Thomas J. Connelly; Wilhelm Law, S.C.

(57) ABSTRACT

A stretcher pad comprises a mattress; a cuff fixed to an upper surface of the mattress; and a belt assembly arranged for securing one of a child and an infant being wrapped in the cuff; wherein a recess is formed in the mattress for accommodating at least part of the belt assembly; and a pouch is arranged on the mattress so as to cover the recess.

19 Claims, 3 Drawing Sheets

(56) References Cited

U.S. PATENT DOCUMENTS

| | | | | |
|---|---|---|---|---|
| 6,871,368 | B2 * | 3/2005 | Calkin | 5/628 |
| 6,913,020 | B2 * | 7/2005 | Chapman | 128/870 |
| 6,966,087 | B2 * | 11/2005 | Robinette | 5/628 |
| 7,426,761 | B2 * | 9/2008 | Tomcany et al. | 5/628 |
| 8,001,634 | B2 * | 8/2011 | Ayette et al. | 5/628 |
| 8,122,543 | B2 * | 2/2012 | Kenalty et al. | 5/628 |
| 2004/0045089 | A1 | 3/2004 | Zucker et al. | |
| 2004/0221392 | A1 * | 11/2004 | Tsai | 5/628 |
| 2008/0168603 | A1 | 7/2008 | Ayette et al. | |
| 2008/0184488 | A1 * | 8/2008 | Fee et al. | 5/628 |
| 2010/0005593 | A1 * | 1/2010 | Bowling et al. | 5/628 |
| 2010/0299837 | A1 * | 12/2010 | Yandle | 5/628 |

FOREIGN PATENT DOCUMENTS

| | | | |
|---|---|---|---|
| DE | 102005003433 | B3 | 4/2006 |
| DE | 202007016952 | | 5/2009 |
| WO | WO 02/24137 | A1 | 3/2002 |

* cited by examiner

STRETCHER PAD WITH CHILD RESTRAINT SYSTEM

CROSS-REFERENCE TO RELATED APPLICATIONS

The present application claims priority of German Patent Application No 10 2010 005 6191, filed Jan. 25, 2010, the content of which is hereby incorporated by reference in its entirety.

FIELD OF THE INVENTION

The present application relates to stretcher pads, and in particular to stretcher pads which provide facilities to selectively secure either an adult or a child or infant to the stretcher.

BACKGROUND OF THE INVENTION

The stretcher pad according to EP 1 318 782 81 provides a combined patient restraint system consisting of a restraint system for adults in addition to a restraint system for children and infants.

In practice, it has been found that the restraint system currently now in use is cumbersome to stow, or else presents a source of irritation or even injury for the patient currently to be secured to the stretcher.

SUMMARY OF THE INVENTION

In order to avoid the drawbacks of the prior art, according to a first aspect a stretcher pad comprises a mattress, a cuff fixed to an upper surface of the mattress, and a belt assembly arranged for securing one of a child and an infant being wrapped in the cuff, wherein a recess is formed in the mattress for accommodating at least part of the belt assembly, and a pouch is arranged on the mattress so as to cover the recess.

With this arrangement, a part of the belt assembly currently not in use can be stowed away in the recess below the pouch, to not thereby irritate or injure an adult person lying on the mattress and pouch. In addition, the cuff flaps may be used to stow other parts of the belt assembly toward both lateral sides of the stretcher pad.

Conversely, when a child or infant is to be transported with the stretcher, it may be secured with either the cuff (infant) or the belt assembly (child) as the case may be.

In either event, the patient is not irritated by components not actually in use, nor is there any danger of medical staff using inappropriate securing means.

According to another aspect, a stretcher pad comprises a mattress, a cuff fixed to an upper surface of the mattress, and a belt assembly arranged for securing one of a child and an infant being wrapped in the cuff, wherein the cuff comprises two laterally opposed flaps extending to either side from the upper surface of the mattress, each of the two laterally opposed flaps having a cutout section, the laterally opposed flaps being arranged for passing between the body and the respective arm of the child or infant in a state in which the child or infant is secured by the belt assembly and the cuff. In this manner, it is facilitated to securely wrap the child or infant with the cuff, while at the same time it is facilitated to securely fasten the cuff and the belt arrangement to the mattress.

According to yet another aspect, a stretcher pad comprises a mattress, a cuff fixed to an upper surface of the mattress, and a belt assembly arranged for securing one of a child and an infant being wrapped in the cuff, wherein a recess is formed in the mattress for accommodating at least part of the belt assembly, and wherein the cuff comprises two laterally opposed flaps extending to either side from the upper surface of the mattress, each of the two laterally opposed flaps having a cutout section, the laterally opposed flaps being arranged for passing between the body and the respective arm of the child or infant in a state in which the child or infant is secured by the belt assembly and the cuff. In this manner, the various advantages explained above are simultaneously achieved.

BRIEF DESCRIPTION OF THE DRAWINGS

The foregoing as well as other advantageous features of the invention will be more apparent from the following detailed description of exemplary embodiments of the invention with reference to the accompanying drawings. Not all possible embodiments of the present invention necessarily exhibit each and every, or any, of the advantages identified herein.

DETAILED DESCRIPTION OF EXEMPLARY EMBODIMENTS

Figure 1:
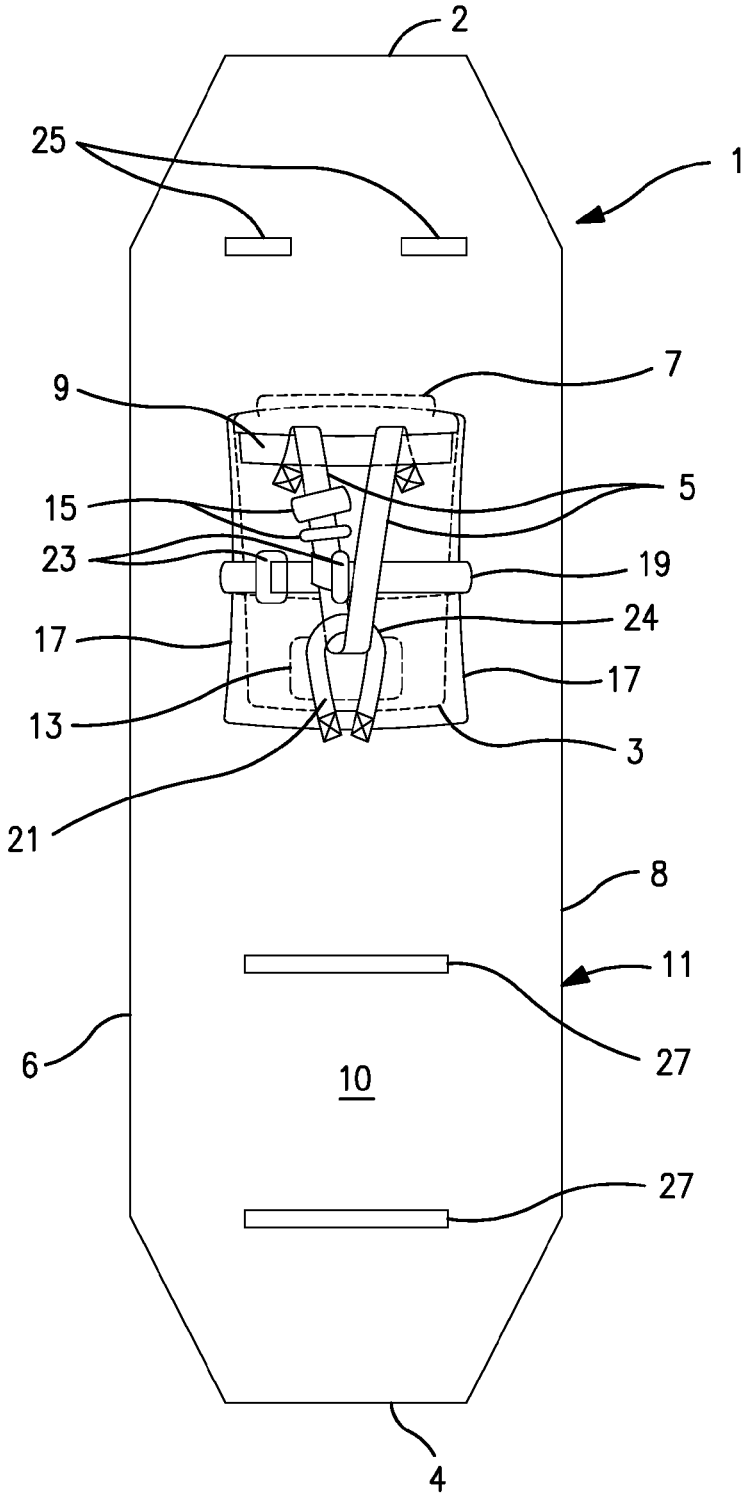
FIG. 1 is a front view a stretcher pad according to this invention.

In the exemplary embodiments described below, components that are alike in function and structure are designated as far as possible by like reference numerals. Therefore, to understand the features of the individual components of a specific embodiment, the descriptions of other embodiments and of the summary of the invention should be referred to.

Figure 2A:
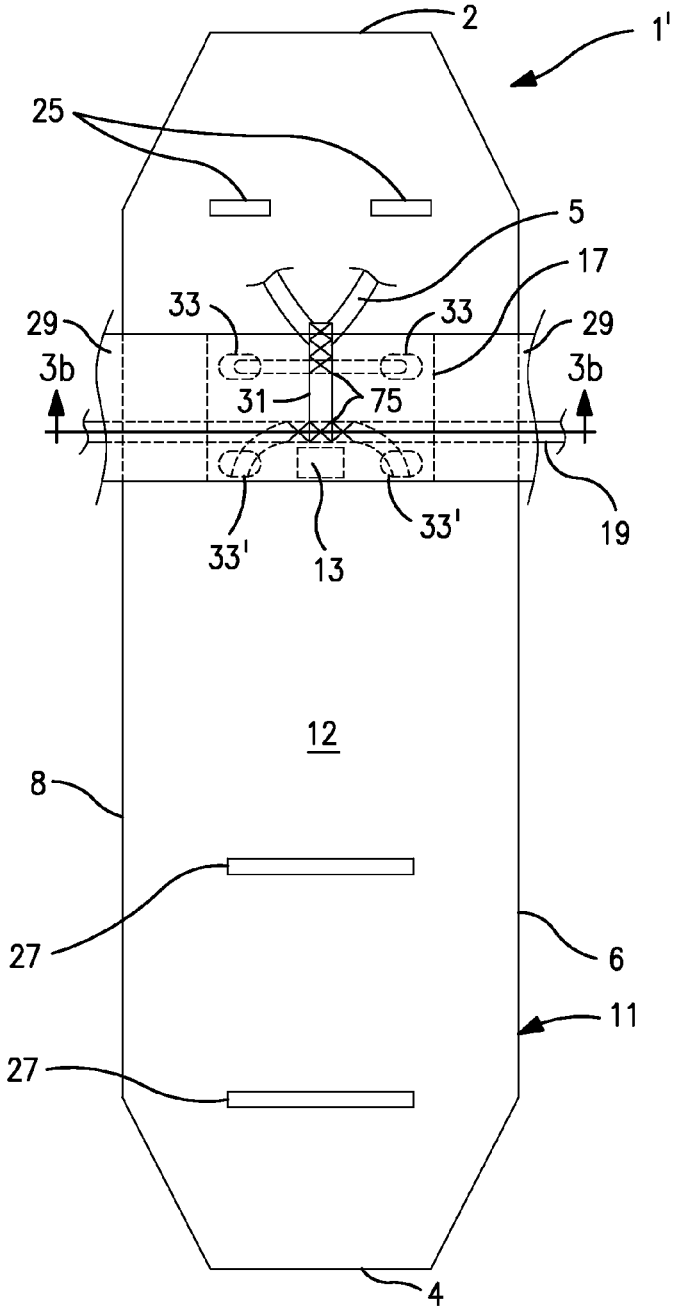
FIG. 2*a* is a back view of an alternative embodiment of a stretcher pad.

Referring to FIGS. 1, 2*a* and 4, a stretcher pad 1 or 1' is shown which is sized and configured to support a patient 30, see FIG. 4. The patient 30 can be an infant, a child or an adult. The stretcher pad 1 or 1' is especially designed for an infant or a child. The stretcher pad 1 or 1' includes a mattress 11 formed from a foam material. The mattress 11 has a first end 2, a second end 4, and a pair of lateral sides 6 and 8. The first end 2 is located adjacent to a patient's head and the second end 4 is located adjacent to a patient's feet when the patient is lying on the stretcher pad 1 or 1'. The pair of lateral sides 6 and 8 is situated between the first end 2 and the second end 4. The mattress 11 also has an upper surface 10 and an oppositely aligned lower surface 12. The back of a patient, when positioned on the stretcher pad 1 or 1', would contact the upper surface 10. Secured and positioned on the upper surface 10 of the mattress 11 is a pouch 3. The pouch 3 is arranged or located approximately in a central portion of the mattress 11 corresponding to an area of the mattress 11 which would align with the breast of an infant or child. The pouch 3 includes a zipper 7 which is located adjacent to, yet spaced apart from, the first end 2 of the mattress 11. A pair of shoulder straps 5, 5 are secured to the mattress 11. Each of the pair of shoulder straps 5, 5 can be sewn into the upper surface 10 of the mattress 11 or be secured to the mattress 11 in some other fashion. The pair of shoulder straps 5, 5 can be stowed in the pouch 3. The zipper 7 can be closed after the pair of shoulder straps 5, 5 are inserted in the pouch 3.

Formed within the pouch 3 is a recess 13. The recess 13 is situated near the second end 4. The recess 13 can have a rectangular, round or some other shape. The recess 13 is formed in the foam material of the mattress 11. The recess 13 is completely covered or hidden by the pouch 3. The recess 13 is designed to accommodate a belt lock and/or a belt adjustment mechanism 15 which is attached to the free ends of the pair of shoulder straps 5, 5 when the pair of shoulder straps 5, 5 is not in use. In addition, a retainer strap 9 is fixed on top of the pair of the shoulder straps 5, 5. The retainer strap 9 is arranged relative to the pouch 3 and is guided through holes 33, 33 formed through the mattress 11. The retainer strap 9 extends to the back side or lower surface 12 of the mattress 11. The free ends of the retainer strap 9 are connected, for example, by a nut-and-bolt connection 75 or in some other suitable manner, to the lower surface 12 of the mattress 11. If desired, the retainer strap 9 may be reinforced with a laterally oriented, flat plastic bar (not shown).

Figure 3A:
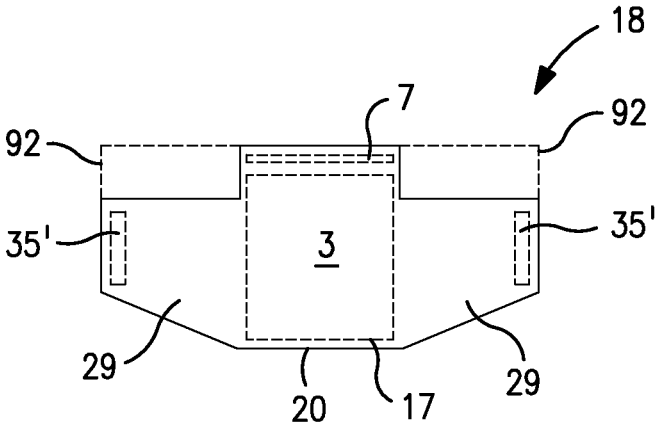
FIG. 3*a* is a front view of a cuff having a pair of flexible lateral flaps.
Figure 3B:
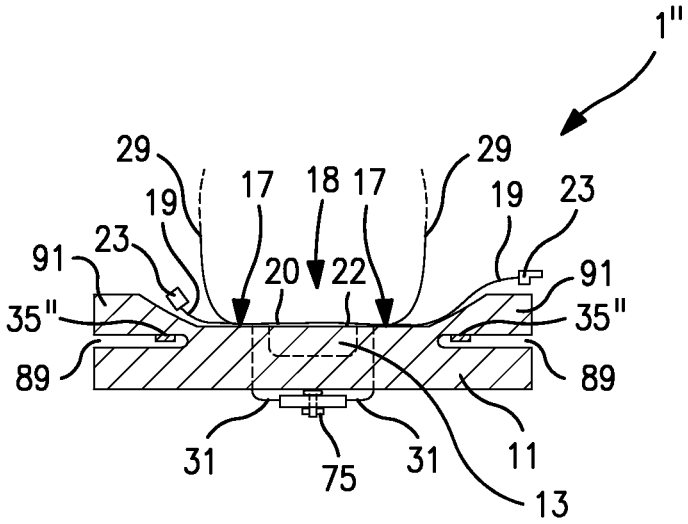
FIG. 3*b* is a cross-sectional view of the stretcher pad shown in FIG. 2*a* taken along line 3*b*-3*b*.

Referring to FIGS. 3*a* and 3*b*, a flexible cuff 18 is depicted which is secured to the upper surface 10 of the mattress 11. The flexible cuff 18 has an outer or top part located closest to the first end 2 of the mattress 11. The cuff 18 includes a pair of rectangular or trapezoidal flexible flaps 29, 29. Each of the pair of flaps 29, 29 extend laterally outward from a central portion 20. Each of the pair of flaps 29, 29 is integrally formed with the central portion 20. The pair of flaps 29, 29 is secured to the upper surface 10 of the mattress 11. For example, the pair of flaps 29, 29 can be sewn into the upper surface 10 of the mattress 11. Together, the central portion 20 and the pair of flexible flaps 29, 29 provide a cuff 18 which can facilitate the transport of a child or infant patient on the stretcher pad 1".

Figure 2B:
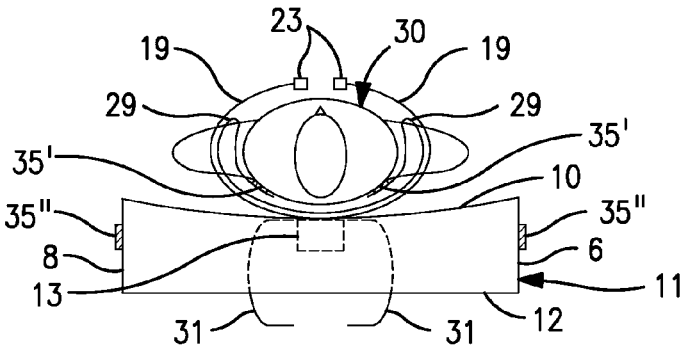
FIG. 2*b* is an end view of the stretcher pad shown in FIG. 2*a* and depicts a child positioned on the upper surface of the mattress.

Referring to FIGS. 2*b*, 3*a* and 3*b*, the stretcher pad 1 also includes a pair of hook components 35", 35" (see FIG. 2*b*) and a pair of loop components 35', 35' (see FIG. 3*a*). Each of the pair of hook components 35", 35" is located on one of the lateral sides 6 and 8 of the mattress 11, approximate the location of the pouch 3. The pair of hook components 35", 35" can be located on the lower surface 12 of the mattress 11 as well. A more desirable alternative is to locate the pair of hook components 35", 35" in a pair of lateral recesses 89, 89 (see FIG. 3*b*) which can extend in the longitudinal direction of the mattress 11. The pair of lateral recesses 89, 89 can extend longitudinally in the mattress 11 approximately the same distance as the length of the pouch 3.

In FIG. 2*b*, the pair of hook components 35", 35" are arranged or positioned on the lateral sides 6 and 8. Each of the pair of loop components 35', 35' (see FIG. 3*a*) can be located on one of the pair of flaps 29, 29 close to an outer edge. The loop components 35', 35' and the hook components 35", 35" cooperate to provide a fastening system. It should be understood that when the flexible cuff 18 is not in use, the pair of flaps 29, 29 can be releasably secured to the outer lateral sides 6 and 8 of the mattress 11 by bringing the pair of loop-components 35', 35' into contact with the pair of hook components 35", 35". The width of each of the pair of flaps 29, 29, as measured in a lateral direction, matches the spacing between the pair of hook components 35, 35". In this position, the pair of flaps 29, 29 cover and secure the ends of a waist belt 19. The waist belt 19 passes through a pair of holes 33, 33' formed through the mattress 11. The pair of holes 33', 33' are located away from the pair of holes 33, 33 through which the retainer strap 9 passes. The pair of holes 33, 33' is located farther away from the first end 2 of the mattress 11 than is the pair of holes 33, 33.

In use, when a patient 30 is positioned or lying on the upper surface 10 of the mattress 11, the waist belt 19 surrounds both of the pair of flaps 29, 29 of the cuff 18. The waist belt 19 is fixed to the lower surface 12 of the mattress 11 and its free ends extend upward through the pair of holes 33', 33' and are situated laterally outside of the pair of flaps 29, 29. Desirably, the waist belt 19 is located in the same area of the mattress 11 where the pair of the longitudinal recesses 89, 89 is formed in the lateral sides 6 and 8. Similarly, as the retainer strap 9 for the pair of shoulder straps 5, 5, the ends of the waist belt 19 are guided through the holes 33, 33' formed in the mattress 11 to the back side or lower surface 12 thereof. The ends of the waist belt 19 are connected, for example, by a nut-and-bolt connection 75 or in some other suitable manner. Where the flexible cuff 18 contacts the mattress 11, or at least at a circumference of such contact area, the flexible cuff 18 is secured to the mattress 11, such as by stitching, by a weld or in some other fashion, in order to avoid contamination of the waist belt 19 with body fluids, during use of the stretcher pad 1 or 1'. In addition, at the point where the waist belt 19 penetrates the surface of the mattress 11, a sealing material, such as an adhesive, (not shown) can be provided so that no blood or other body fluid can enter the space therebetween.

Referring again to FIG. 2*a*, one will notice that at the position where the recess 13 is formed in the upper surface 10 of the mattress 11, the back-side of the pouch 3 has an opening of matching size. This opening provides one possible way of attaching the retaining strap 9 and the waist belt 19 to the mattress 11. The pair of flaps 29, 29 is shown in the open state wherein their outer ends are not fixed to the mattress 11. In this variant, the waist belt 19 and the retainer strap 9 are fixed to a connecting strap 31. The free ends of the waist belt 19 are guided through holes 33', 33' formed through the mattress 11 and the free ends of the retainer strap 9 are guided through the holes 33, 33 formed through the mattress 11.

Referring to FIG. 2*b*, an, end view of a child (as opposed to an infant) is shown lying on the upper surface 10 of the mattress 11. In this view, the pair of flaps 29, 29 is folded inside for transport of the child. The pair of flaps 29, 29 protect the child's sides or breast, and the ends of the waist belt 19 are joined or connected together by a belt lock or buckle 23. The pair of hook components 35", 35" (shown in their idle state) is arranged on the outer lateral sides 6 and 8 of the mattress 11. It should be understood that in FIG. 2*b*, no longitudinal recesses 89, 89 are present. In another variant, it is possible to arrange the pair of hook components 35", 35" so that they are located on the back-side or lower surface 12 of the mattress 11, as long as they do not interfere with the stretcher pad 1.

Referring back to FIG. 2*a*, one will notice that the pair of shoulder straps 5, 5 is shown as being sewn together in a Y-shape. This Y-shape is a desirable alternative to the separate attachment method shown in FIG. 1. A securement 22 surrounds the contact area between the flexible cuff 18 and mattress 11. The securement 22 can be stitching, a weld or some other type of attachment known to those skilled in the art. Note, that when an infant is to be transported, neither of the pair of flaps 29, 29 is folded. Instead, the pair of flaps 29, 29 is wrapped around the body of the infant. In this context, an infant is meant to be a particularly young or small child.

Referring again to FIG. 1, if required, a crotch strap 21 may be provided, although it is usually not necessary. If present, the ends of such a crotch strap 21 can include a belt lock or buckle 23 or the crotch strap 21 can be configured into a loop. Likewise, the pair of shoulder straps 5, 5 can also include a belt lock or buckle 23. In use, the pair of shoulder straps 5, 5 can be configured to form a loop which surrounds the waist belt 19, and if a crotch strap 21 is present, the pair of shoulder straps 5, 5 can also form a loop around the crotch strap 21. Alternatively, the pair of shoulder straps 5, 5 can loop around only the crotch strap 21.

Referring to FIG. 3*a*, a modified arrangement of the flexible cuff 18 is shown having a central portion 20 forming the pouch 3 and having a pair of laterally, opposed flaps 29, 29 extending outward from the central portion 20. Each of the pair of flaps 29, 29 has a cut-out section 92 (depicted by dotted lines) facing towards the first end 2 of the mattress 11. The cut out sections 92, 92 permit the pair of flaps 29, 29, during use, to be positioned or arranged between the body and the arms of the child or infant, which needs to be secured to the stretcher pad 1". A person skilled in the art will note that only the cuff 18 is shown in FIG. 3*a*. The mattress 11 has been omitted solely for the purpose of clarity. In this configuration, the pair of flaps 29, 29 provide a secure stop hindering the transported child or infant from slipping towards the second end 4. This configuration secures the child or infant even in the case where the child or infant is being carried upwards at an angle, or in the case where the transporting vehicle is in an accident.

Still referring to FIG. 3*a*, the pair of loop components 35', 35 is indicated by dashed lines. Each of the pair of loop components 35', 35' is positioned on a far side of each of the flaps 29, 29. In this example, the lower, outer edges of the flaps 29, 29, those located closest to the second end 4 of the mattress 11, are obliquely shaped, so that the overall shape of the flexible cuff 18 is trapezoidal. The flexible cuff 18 can also be configured into other shapes. The flexible cuff 18 can be configured to have a rectangular shape, a rounded shape, or some other desired shape. The pair of shoulder straps 5, 5 (not shown in FIG. 3*a*) provide a similar stop against movement of the child or infant towards the first end 2 of the mattress 11. The flexible cuff 18, together with the waist strap 19, secures the child or infant against acceleration away from the mattress 11. In this manner, the transported child or infant remains attached to the mattress 11 even in the case where the transporting vehicle is overturned in the event of an accident. The crotch strap 21 is not necessary since the cooperation between the pair of shoulder straps 5, 5 and the waist belt 19 is sufficient to hold the child or infant secure.

Referring again to FIG. 3*b*, the pair of longitudinally extending recesses 89, 89 is clearly shown between the upper surface 10 and the lower surface 12. In this embodiment, the upper surface 10 has a pair of wedge-shaped portions 91, 91. The pair of longitudinally extending recesses 89, 89 accommodate the pair of hook components 35", 35". One will also notice that the central portion 20 of the cuff 18 is connected to the upper surface 10 of the mattress 11 by the securement 22. In this figure, the full extent of the pair of flaps 29, 29 is not shown, solely for simplicity. Also, the ends of the waist belt 19 are connected at the back or lower surface 12 of the mattress 11 by a nut-and-bolt connector 75. Furthermore, the ends of the retainer strap 9, (not shown in this view), would be located approximately between the cutout sections 92, 92.

Referring again to FIGS. 1 and 2*a*, the stretcher pad 1 or 1' further includes a pair of substantially laterally oriented slits 25, 25 formed through the mattress 11 approximate the first end 2. The pair of slits 25, 25 are situated side by side in a spaced apart arrangement. The pair of slits 25, 25 function to guide the pair of shoulder straps 5, 5 when an adult is to be carried on the stretcher pad 1. Furthermore, the leg portion of the mattress 11, that being the section closest to the second end 4, has at least one or two laterally arranged interruptions 27, 27. Two spaced apart interruptions 27, 27, spaced along the longitudinal central axis of the stretcher pad 1, are depicted in FIGS. 1 and 2*a*. Each of the interruptions 27, 27 function to provide foldability of the mattress 11. The ability of fold the foam mattress 11 provides a convenient way to stow it away in a small compartment. For example, the stretcher pad 1 or 1' can be stowed in a transportation vehicle, such as an ambulance or a helicopter. In addition, interruptions 27, 27 can also be provided in the mattress 11 where the pair of slits 25, 25 is formed and/or at a bottom edge of the pouch 3 (not shown). Near the first end 2 of the mattress 11, there may be provided further Velcro® (hook-and-loop) components (not shown) which may serve to attach a pillow or the like carrying the complementary components.

As for the materials preferably used, all the belts and straps may, without limitation, be made from polyester. The belt locks 23 are preferably made from a suitable metal. An exemplary mattress 11 has a layered structure with a PVC bottom layer, a foamed interior and a synthetic leather top layer. The pair of loop fasteners 35', 35 and the pair of hook fasteners 35', 35" are preferably, without limitation, made from weldable polyamide, while the zipper 7 is made from a suitable plastic material. The shoulder straps 5, 5 preferably have sheaths made from synthetic leather. It is advisable to provide the polyester straps with synthetic leather sheaths wherever they are guided through, for example, the top and bottom layers of the mattress 11 to prevent wear.

While the invention has been described with respect to certain exemplary embodiments thereof, it is evident that many alternatives, modifications and variations will be apparent to those skilled in the art. Accordingly, the exemplary embodiments of the invention set forth herein are intended to be illustrative and not limiting in any way. Various changes may be made without departing from the spirit and scope of the present invention as defined in the following claims.

Having thus described the invention, what is claimed is:

1. A stretcher pad comprising:

a) a mattress formed from a foam material, said mattress having a first end, a second end, a pair of lateral sides located between said first and second ends, and an upper surface;

b) a pouch secured to said upper surface of said mattress, said pouch having a zipper which can be opened to gain access into said pouch;

c) a recess formed in said mattress, said recess being covered by said pouch;

d) a cuff fixed to said upper surface of said mattress, said cuff including a pair of flexible lateral flaps which can be wrapped around at least a portion of a patient's breast; and e) a waist belt for securing said patient in the cuff, said waist belt being positioned in said recess when stored.

2. The stretcher pad of claim 1 wherein said patient is a child and said pouch is secured to said mattress and is aligned with said child's breast when said child is positioned on said mattress.

3. The stretcher pad of claim 2, wherein said pouch is secured to a central portion of said mattress.

4. The stretcher pad of claim 1 wherein said patient has a body and a pair of arms, and said cuff is flexible and includes a central portion, each of said flaps being laterally opposed and having a cutout section and each of said laterally opposed flaps passes between said patient's body and a respective arm when said patient is positioned on said mattress.

5. The stretcher pad of claim 1 wherein said patient is an infant, and said pair of lateral flaps can wrap around said infant's breast when said infant is lying on said mattress.

6. The stretcher pad of claim 1 further comprising a crotch strap secured to said mattress wherein the crotch strap cooperates with said pair of shoulder straps to secure said patient to said mattress.

7. The stretcher pad of claim 1 further comprising a pair of shoulder straps secured to said mattress, said pair of shoulder straps being positioned in said pouch when being stored.

8. The stretcher pad of claim 1 wherein said mattress has two interruptions formed therethrough approximate said second end.

9. The stretcher pad of claim 1 wherein said mattress has a pair of slits formed therethrough approximate said first end.

10. The stretcher pad of claim 1 further including two interruptions formed through said mattress approximate said second end, said two interruptions being longitudinally spaced apart from one another and located between said pouch and said second end of said mattress.

11. The stretcher pad of claim 1 wherein said mattress has a pair of slits formed through said mattress approximate said first end, said pair of slits being arranged side by side.

12. A stretcher pad comprising:

a) a mattress formed from a foam material, said mattress having a first end, a second end, a pair of lateral sides located between said first and second ends, a pair of slits formed through said mattress approximate said first end, and an upper surface;

b) a pouch secured to said upper surface of said mattress, said pouch having a zipper which can be opened to gain access into said pouch;

c) a recess formed in said mattress said recess being covered by said pouch;

d) a flexible cuff fixed to said upper surface of said mattress, said flexible cuff including a central portion and a pair of lateral flaps extending outward from said central portion which can be wrapped around at least a portion of a patient's breast; and e) a waist belt for securing said patient in said flexible cuff, and said waist belt being stored in said recess.

13. The stretcher pad of claim 12 wherein said patient is a child, and said pair of lateral flaps can wrap around said child's breast when said child is lying on said mattress.

14. The stretcher pad of claim 12 further comprising a pair of shoulder straps secured to said mattress, said pair of shoulder straps being positioned in said pouch when being stored.

15. A stretcher pad comprising:

a) a mattress formed from a foam material, said mattress having a first end, a second end, a pair of lateral sides located between said first and second ends, and an upper surface;

b) a pouch secured to said upper surface of said mattress, said pouch having a zipper which can be opened to gain access into said pouch;

c) a recess formed in said mattress, said recess being covered by said pouch;

d) a flexible cuff fixed to said upper surface of said mattress, said flexible cuff having a central portion and a pair of flexible lateral flaps extending outward from said central portion, wherein said pair of flexible lateral flaps can be wrapped around at least a portion of a patient's breast; and e) a waist belt for securing said patient in the flexible cuff, said waist belt being positioned in said recess when stored.

16. The stretcher pad of claim 15 further comprising a pair of shoulder straps secured to said mattress, said pair of shoulder straps being positioned in said pouch when being stored.

17. The stretcher pad of claim 16 further comprising a retainer strap which cooperates with said pair of shoulder straps to secure a patient to said mattress.

18. The stretcher pad of claim 15 further including two interruptions formed through said mattress approximate said second end, said two interruptions being longitudinally spaced apart from one another and located between said pouch and said second end of said mattress.

19. The stretcher pad of claim 15 wherein said patient has a body and a pair of arms, each of said flaps having a cutout section and each of said laterally opposed flaps passes between said patient's body and a respective arm when said patient is positioned on said mattress.

* * * * *